US010779106B2

(12) United States Patent
Chen et al.

(10) Patent No.: US 10,779,106 B2
(45) Date of Patent: Sep. 15, 2020

(54) AUDIO OBJECT CLUSTERING BASED ON RENDERER-AWARE PERCEPTUAL DIFFERENCE

(71) Applicant: DOLBY LABORATORIES LICENSING CORPORATION, San Francisco, CA (US)

(72) Inventors: Lianwu Chen, Beijing (CN); Lie Lu, San Francisco, CA (US); Dirk Jeroen Breebaart, Ultimo (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/310,569

(22) PCT Filed: Jul. 13, 2017

(86) PCT No.: PCT/US2017/041992
§ 371 (c)(1),
(2) Date: Dec. 17, 2018

(87) PCT Pub. No.: WO2018/017394
PCT Pub. Date: Jan. 25, 2018

(65) Prior Publication Data

US 2019/0182612 A1 Jun. 13, 2019

Related U.S. Application Data

(60) Provisional application No. 62/364,800, filed on Jul. 20, 2016.

(30) Foreign Application Priority Data

Jul. 20, 2016 (CN) ..... 2016 1 0569473
Jul. 20, 2016 (EP) ..... 16180310

(51) Int. Cl.
*H04S 7/00* (2006.01)
*H04R 5/02* (2006.01)
*H04S 3/00* (2006.01)

(52) U.S. Cl.
CPC ..... *H04S 7/303* (2013.01); *H04R 5/02* (2013.01); *H04S 3/008* (2013.01); *H04S 7/30* (2013.01);
(Continued)

(58) Field of Classification Search
CPC . H04S 7/303; H04S 7/30; H04S 7/308; H04S 3/008; H04S 2400/01;
(Continued)

(56) References Cited

U.S. PATENT DOCUMENTS 7,842,876 B2 * 11/2010 Benyamin ..... G11B 27/105 84/615
8,271,290 B2 9/2012 Breebaat
(Continued)

FOREIGN PATENT DOCUMENTS

WO 2014/187990 11/2014
WO 2015/017037 2/2015
(Continued)

*Primary Examiner* — William A Jerez Lora

(57) ABSTRACT

Example embodiments disclosed herein relate to audio object clustering based on renderer-aware perceptual difference. A method of processing audio objects is provided. The method includes obtaining renderer-related information indicating a configuration of a renderer. The method also includes determining, based on the obtained renderer-related information, a rendering difference between a first audio object and a second audio object among the audio objects with respect to the renderer. The method further includes clustering the audio objects at least in part based on the rendering difference. Corresponding system, device, and computer program product are also disclosed.

21 Claims, 4 Drawing Sheets

(52) U.S. Cl.
CPC ..... *H04S 7/308* (2013.01); *H04S 2400/01* (2013.01); *H04S 2400/11* (2013.01); *H04S 2400/13* (2013.01); *H04S 2420/01* (2013.01)

(58) Field of Classification Search
CPC ..... H04S 2400/11; H04S 2400/13; H04S 2420/01; H04R 5/02
USPC ..... 381/56, 58, 124, 303, 310
See application file for complete search history.

(56) References Cited

U.S. PATENT DOCUMENTS

| | | | | |
|---|---|---|---|---|
| 8,560,303 | B2 | 10/2013 | Beack | |
| 8,682,679 | B2 * | 3/2014 | Breebaart | H04S 3/008 704/500 |
| 9,712,939 | B2 | 7/2017 | Mateos Sole | |
| 9,805,725 | B2 | 10/2017 | Crockett | |
| 2008/0144864 | A1 | 6/2008 | Huon | |
| 2012/0269353 | A1 * | 10/2012 | Herre | G10L 19/008 381/22 |
| 2015/0194158 | A1 * | 7/2015 | Oh | G10L 19/008 381/22 |
| 2015/0223002 | A1 | 8/2015 | Mehta | |
| 2015/0332680 | A1 | 11/2015 | Crockett | |
| 2015/0350802 | A1 | 12/2015 | Jo | |
| 2015/0350804 | A1 | 12/2015 | Crockett | |
| 2016/0007133 | A1 | 1/2016 | Mateos Sole | |
| 2017/0171687 | A1 | 6/2017 | Breebaart | |

FOREIGN PATENT DOCUMENTS

| | | |
|---|---|---|
| WO | 2015/017235 | 2/2015 |
| WO | 2015/066062 | 5/2015 |
| WO | 2015/105748 | 7/2015 |
| WO | 2015/144409 | 10/2015 |

* cited by examiner

AUDIO OBJECT CLUSTERING BASED ON RENDERER-AWARE PERCEPTUAL DIFFERENCE

CROSS-REFERENCE TO RELATED APPLICATIONS

This application claims priority to U.S. Provisional Patent Application No. 62/364,800 filed on Jul. 20, 2016, EP Patent Application No. 16180310.1 filed on Jul. 20, 2016 and CN Patent Application No. 201610569473.2 filed on Jul. 20, 2016, each of which is incorporated herein by reference in its entirety.

TECHNOLOGY

Example embodiments disclosed herein generally relate to object-based audio processing, and more specifically, to a method and system for audio object clustering based on renderer-aware perceptual difference.

BACKGROUND

Traditionally, audio content of multi-channel format (for example, stereo, 5.1, 7.1, and the like) is created by mixing different audio signals in a studio, or generated by recording acoustic signals simultaneously in a real environment. More recently, object-based audio content has become more and more popular as it carries a number of audio objects and audio beds separately so that it can be rendered with much improved precision compared with traditional rendering methods. As used herein, the term "audio object" or "object" refers to individual audio elements that may exist for a defined duration of time but also has associated metadata describing information related to the object, such as the spatial position, velocity, content type, object width, loudness, and the like. As used herein, the term "audio bed" or "bed" refers to audio channels that are meant to be reproduced in predefined and fixed speaker locations.

For example, cinema sound tracks may include many different sound elements corresponding to images on the screen, dialogs, noises, and sound effects that emanate from different places on the screen and combine with background music and ambient effects to create the overall auditory experience. Accurate playback requires the sounds to be reproduced in such a way that corresponds as closely as possible to what is shown on screen with respect to sound source position, intensity, movement, and depth. Object-based audio systems represent a significant improvement over traditional channel-based audio systems that send audio content in the form of speaker feeds to individual speakers in a listening environment and are thus relatively limited with respect to spatial playback of specific audio objects.

During transmission of object-based audio content, beds and objects can be sent separately and then used by a spatial reproduction system to recreate the artistic intent using a variable number of speakers in known physical locations. In some situations, there may be tens or even hundreds of individual audio objects contained in the audio content. The large number of audio signals in the object-based content poses new challenges for various aspects related to processing of such content such as transmission, distribution, coding, and storage of such content.

For example, in some distribution and transmission systems, a transmission capacity may be provided with large enough bandwidth available to transmit all audio beds and objects with little or no audio compression. However, in some cases such as distribution via Blu-ray disc, broadcast (cable, satellite and terrestrial), mobile (3G, 4G as well as 5G), or over-the-top (OTT, or the Internet), the available bandwidth is insufficient to transmit information concerning all of the beds and objects created by an audio mixer. While audio coding methods (lossy or lossless) may be applied to the audio to reduce the required bandwidth, transmission bandwidth is usually still a bottleneck, especially for those networks with very limited bandwidth resources such as 3G, 4G as well as 5G mobile systems. High computational, transmission, and/or storage capacities may also be required for other aspects of processing such as coding and storage.

Therefore, it is desired to reduce the number of audio signals in the object-based content (for example, audio objects) in order to reduce computational complexity, transmission bandwidth requirements, and/or storage requirements.

SUMMARY

Example embodiments disclosed herein propose a solution for audio object clustering based on renderer-aware perceptual difference.

In a first aspect, example embodiments disclosed herein provide a method of processing audio objects. The method includes obtaining renderer-related information indicating a configuration of a renderer. The method also includes determining, based on the obtained renderer-related information, a rendering difference between a first audio object and a second audio object among the audio objects with respect to the renderer. The method further includes clustering the audio objects at least in part based on the rendering difference. Embodiments in this regard further provide a corresponding computer program product.

In a second aspect, example embodiments disclosed herein provide a system for processing audio objects. The system includes an information obtaining unit configured to obtain renderer-related information indicating a configuration of a renderer. The system also includes a difference determining unit configured to determine, based on the obtained renderer-related information, a rendering difference between a first audio object and a second audio object among the audio objects with respect to the renderer. The system further includes a cluster subsystem configured to cluster the audio objects at least in part based on the rendering difference.

In a third aspect, example embodiments disclosed herein provide a device for processing audio objects. The device includes a processing unit and a memory storing instructions that, when executed by the processing unit, cause the device to perform steps of the method described in the first aspect.

Other advantages achieved by example embodiments disclosed herein will become apparent through the following descriptions.

DESCRIPTION OF DRAWINGS

Through the following detailed description with reference to the accompanying drawings, the above and other objectives, features and advantages of example embodiments disclosed herein will become more comprehensible. In the drawings, several example embodiments disclosed herein will be illustrated in an example and non-limiting manner, wherein.

Throughout the drawings, the same or corresponding reference symbols refer to the same or corresponding parts.

DESCRIPTION OF EXAMPLE EMBODIMENTS

Figure 1A:
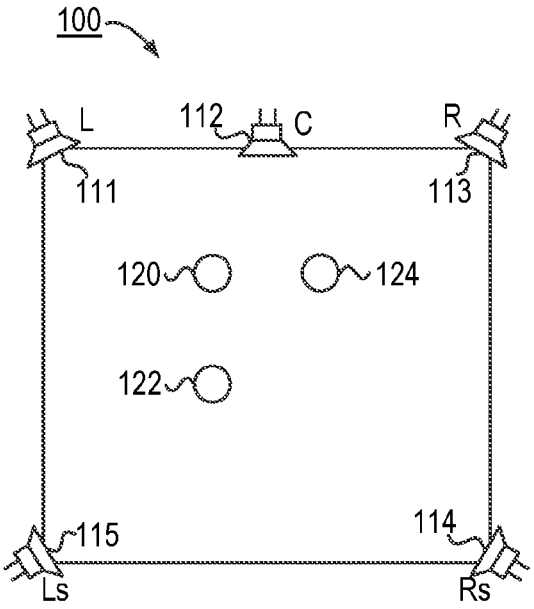
FIGS. 1A and 1B are two examples of possible mismatch between spatial difference and rendering difference on playback systems.

Principles of example embodiments disclosed herein will now be described with reference to various example embodiments illustrated in the drawings. It should be appreciated that depiction of those embodiments is only to enable those skilled in the art to better understand and further implement example embodiments disclosed herein and is not intended for limiting the scope disclosed herein in any manner.

As used herein, the term "includes" and its variants are to be read as open-ended terms that mean "includes, but is not limited to." The term "or" is to be read as "and/or" unless the context clearly indicates otherwise. The term "based on" is to be read as "based at least in part on." The term "one example embodiment" and "an example embodiment" are to be read as "at least one example embodiment." The term "another embodiment" is to be read as "at least one other embodiment". The terms "first," "second," and the like may refer to different or same objects.

As used herein, the terms "clustering," "grouping," or "combining" are used interchangeably to describe the allocation of objects and/or beds (channels) into "clusters" or "cluster signals," in order to reduce the amount of audio objects for rendering in an adaptive audio playback system. As used herein, the term "rendering" or "panning" may refer to a process of transforming audio signals (for example, audio objects or cluster signals) into feed signals for output channels of a particular playback system. As used herein, the term "spatial difference" refers to the spatial proximity or spatial distance between two audio objects, which may be determined based on the spatial positions of the audio objects. The term "rendering difference" refers to difference of rendering parameters or rendering manners (behaviors) of two audio objects with respect to a renderer using a specific rendering scheme. Other definitions, either explicit or implicit, may be included below.

In typical object-based audio signal processing frameworks, in order to reduce computational complexity, storage requirements, and/or transmission bandwidth requirements, the number of input audio objects and beds in audio content is reduced into a smaller set of output objects by means of clustering. The audio beds may be regarded as audio objects during the clustering. Essentially, the input audio objects are combined into single or fewer new, merged objects. The output objects may also be referred to as clusters or cluster signals. In many use cases, the output objects may be delivered to an audio playback system for rendering.

The purpose of the audio object clustering is to reduce the number of individual audio elements (beds and objects) to be delivered to the playback system, but still retain enough spatial information so that an error between directly rendering the input audio objects and rendering the output cluster signals is reduced or minimized. Clustering audio objects into cluster signals in many conventional clustering methods is based on spatial proximity of the audio objects. That is, audio objects that have smaller spatial distances are combined into one cluster while ensuring a small overall spatial distortion and/or preserving the overall perception. This process is generally effective as long as spatial positions of all perceptually relevant objects in the audio content allow for such clustering with a reasonably small error.

Figure 1B:
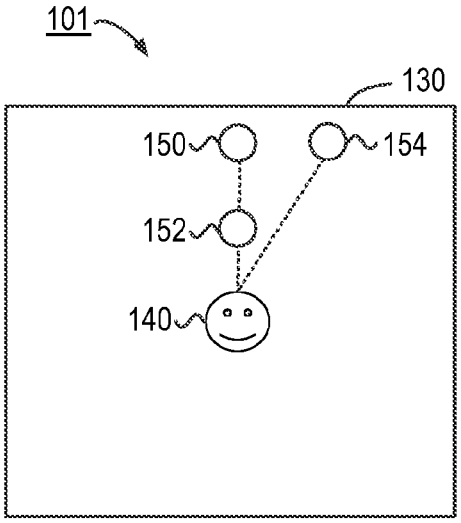

However, the spatial distances of audio objects does not always reflect the perceptual difference of audio objects on playback systems after rendering. With the same spatial distance, it is possible that one pair of audio objects sound similar while another pair of audio objects sound quite different in the playback systems. FIGS. 1A and 1B depict two illustrative examples of possible mismatch between the spatial difference and the rendering difference of audio objects in playback systems. As shown in a scenario of a speaker playback system 100 in FIG. 1A, there are three audio objects 120, 122, and 124 to be clustered into two clusters and further reproduced by a 5.1 playback system. The 5.1 playback system includes a subwoofer speaker (not shown), a left (L) speaker 111, a center (C) speaker 112, a right (R) speaker 113, a right-surround (Rs) speaker 114, and a left-surround (Ls) speaker 115. During the rendering, a renderer may be used to render each of the audio objects to one or more of the speakers 111-115 with corresponding object-to-speaker gain(s).

It is assumed that the spatial distance between the audio objects 120 and 122 is equal to the spatial distance between the audio objects 120 and 124. According to most rendering schemes that can be employed by renders in speaker playback systems, both the audio objects 120 and 122 may be rendered to an active speaker set including speakers 111, 112, 114, and 115, while the audio object 124 may be rendered to an active speaker set including speakers 112, 113, 114, and 115. That is, in many cases the rendering difference between the audio objects 120 and 122 is smaller than that between the audio objects 120 and 124 although the spatial differences between the two pairs of audio objects are the same. Therefore, it is desirable to combine the audio objects 120 and 122 in one cluster and allocate the audio object 124 in another cluster.

However, the conventional proximity-based clustering methods are not able to ensure such clustering results due to the same spatial differences between the two pairs of audio objects. The clustering results may be even more undesirable when the audio object 122 is moved a little far away from the audio object 120 and thereby there will be a higher probability that the audio objects 120 and 124 are combined in one cluster in this case. The same mismatch between the spatial difference and the rendering difference may also occur in the scenario of headphone playback system 101 shown in FIG. 1B. In the headphone scenario 101, the listening environment for a listener 140 with a headphone (or a headset) may be virtualized as a virtual room 130 with the listener 140 in the center. There are three audio objects 150, 152, and 154 to be clustered into two clusters and further rendered by the headphone playback system, where a spatial distance between the audio objects 150 and 152 is equal to a spatial distance between the audio object 150 and the audio object 154.

According to most rendering schemes that can be employed by renders in headphone playback systems, a binaural model may be constructed and head related transfer functions (HRTFs) are utilized in the binaural model to represent the propagation process (or an acoustic transfer) from sound sources located at various spatial positions to the human ears. Since the audio objects 150 and 152 are in the same direction relative to the listener 140, HRTFs used for rendering the audio object 150 may be the same or similar to those used for rendering the audio object 152. HRTFs of the audio object 154 in another direction may be quite different from those of the audio objects 150 and 152. That is, in many cases the rendering difference between the audio objects 150 and 152 is smaller than that between audio objects 150 and 154 although the spatial differences between the two pairs of audio objects are the same. However, the same problem of undesirable clustering will arise in this scenario 101 as in the scenario 100.

A difference between two audio objects is an important factor in audio object clustering. However, as discussed above, the audio object clustering based on the traditional spatial difference may not be able to provide desirable rendering results in some cases. In order to improve the audio object clustering process, example embodiments disclosed herein introduce a new factor to be used in audio object clustering. This new factor is measured by a difference between rendering of an audio object by a potential renderer at playback side and rendering of another audio object by the renderer. Thus, this factor may be referred to as a rendering difference between two audio objects. This factor may also be called as a renderer-aware perceptual difference (or distance) between two audio objects since this factor is measured with respect to the renderer. As used herein, the terms "rendering difference," "renderer-aware perceptual difference" "perceptual difference," "renderer-aware perceptual distance," and "perceptual distance" are used interchangeably.

In accordance with example embodiments disclosed herein, a rendering difference between a pair of audio objects with respect to a renderer is determined based on renderer-related information and used to control the audio object clustering process. In some example embodiments, the rendering difference may be used in replace of the spatial difference between the two audio objects. In this case, the use of the spatial difference in various existing audio clustering methods may be simply replaced by the rendering difference without disrupting the whole processing flow. Alternatively, the rendering difference may be used in combination with the spatial difference during the audio object clustering. For example, a new difference between two audio objects may be determined by weighting the rendering difference and the spatial difference. Then the new difference may be used in replace of the traditional spatial difference of the two audio objects in the audio object clustering process.

Figure 2:
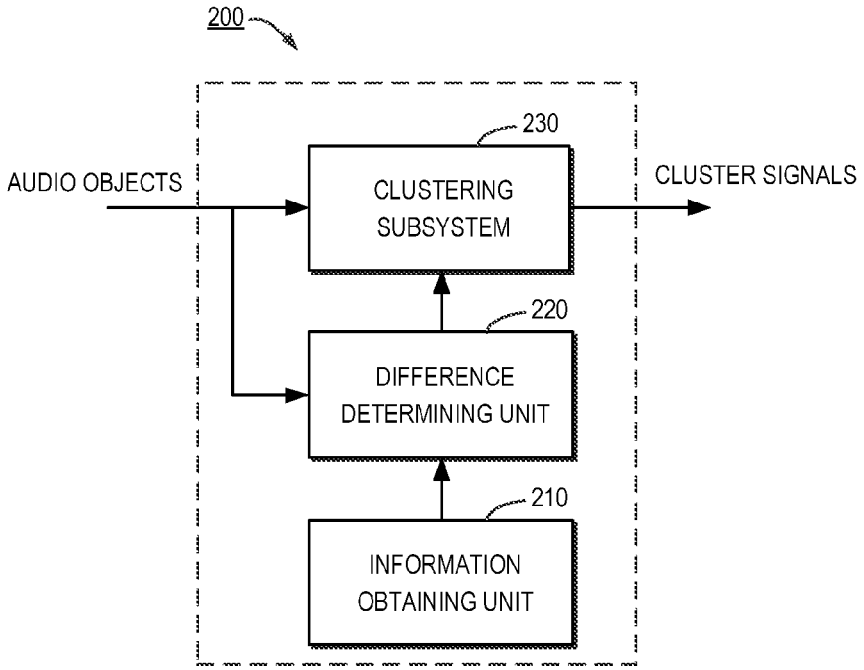
FIG. 2 is a block diagram of a system for processing audio objects in accordance with example embodiments disclosed herein.

FIG. 2 depicts an example system for processing audio objects 200 in accordance with example embodiments disclosed herein. As shown, the system 200 includes an information obtaining unit 210, a difference determining unit 220, and a clustering subsystem 230. The information obtaining unit 210 is configured to obtain renderer-related information. The renderer-related information may indicate a configuration of a renderer. The difference determining unit 220 is configured to determine, based on the renderer-related information provided from the information obtaining unit 210, a rendering difference between two input audio objects with respect to the renderer. The clustering subsystem 230 is configured to cluster the input audio objects at least in part based on the rendering difference.

In some embodiments, the input audio objects are those to be stored or transmitted to audio playback systems for rendering. In order to reduce the complexity of storing, transmitting, and/or rendering, it is desired to perform audio object clustering first. An audio object may have associated metadata describing information related to the object, such as the spatial position (for example, two-dimensional or three-dimensional coordinates), velocity, content type, object width, loudness, and the like. Some of the metadata may also be utilized during the audio clustering process. In some cases, a number of audio beds may also be stored or transmitted along with the audio objects in order to reproduce object-based audio. The audio beds, in one example, may be regarded as one or more audio objects with fixed object positions in the audio object clustering process. Alternatively, the audio beds may not be processed in the clustering process, but will be directly stored or transmitted along with the cluster signals.

In some embodiments, it is assumed that input audio signals are segmented into individual frames which are subjected to the processing disclosed herein and each of the frames may include a plurality of input audio objects and possibly audio beds. Such segmentation may be applied on time-domain waveforms but also using filter banks, or may be performed on any other transform domain such as a discrete cosine transform (DCT), quadrature mirror filter (QMF) bank, discrete Fourier transform (DFT) and the like. The scope of the subject matter disclosed herein is not limited in this regard.

In an audio playback system, a renderer may be designed and utilized to render audio signals to output channels of the playback systems. As discussed above with reference to FIGS. 1A and 1B, the audio object clustering may exhibit better results if audio objects with the same or similar rendering manners are combined in fewer clusters. The rendering manners of audio objects may depend on the configuration of the renderer. Generally, renders in many playback systems may employ various different schemes or algorithms to render an audio object to the output channels, but there are some configurations (or criterions) shared by most of the renders. Based on those shared configurations, it is possible to estimate the rendering difference between audio objects. The renderer-related information obtained by the information obtaining unit 210 may include such rendering configurations of potential renders at the playback side.

In some embodiments, the renderer may include a speaker renderer employed in a speaker playback system. A speaker playback system may include a plurality of speakers (also called as loudspeaker) arranged at the same relative positions in a specific speaker layout. Examples of such speaker layout include, but are not limited to, a 5.1 speaker layout (an example of which is shown in FIG. 1A), a 7.1 speaker layout, a 7.1.4 speaker layout, or a 7.1.6 speaker layout. A speaker renderer may generally pan an audio object across speaker feed signals by selecting a set of active speakers among the plurality of speakers. Depending on the rendering scheme used by the speaker renderer, the selected set of active speakers may be varied. Examples of the rendering scheme include, but are not limited to, pair-wise panning, center-of-mass panning, triple-balance panning, and vector-based amplitude panning (VBAP).

In some other embodiments, the renderer may include a headphone (or headset) renderer employed in a headphone playback system. In headphone rendering, as mentioned above, a binaural model may be constructed and HRTFs are utilized in the model to represent a propagation process (or an acoustic transfer) from a sound source (for example, an audio objects) located at a spatial position to the human ears. In some examples, with the directions of audio objects (e.g. the elevation and azimuth angles with the listener as a reference point), the corresponding HRTFs of different positions of sound sources may be individually calculated by using either the sophisticated data measured on acoustical manikins or some other structural models. Generally, for a sound source at a specific spatial position, two filters may be designed for the human ears by using coefficients of the HRTFs. In this case, the audio object may be rendered to the output channels of the headphone by applying the filters. Depending on different rendering schemes (modeled in different virtual rooms or using different sophisticated data), the headphone renderer may give different rendering results for an audio object.

In the cases of a speaker renderer, the renderer-related information obtained by the information obtaining unit 210 may indicate a reference speaker layout indicating speakers in difference positions and a predefined rendering scheme for the speaker renderer. In the case of a headphone renderer, the renderer-related information obtained by the information obtaining unit 210 may indicate a predefined rendering scheme for the headphone renderer. In some embodiments, the renderer-related information may be predefined for one or more potential speaker or headphone renders. For example, if the input audio objects are intended to be played back in a speaker environment, then only the speaker renderer-related information may be configured. In some embodiments, both the speaker renderer-related information and the headphone renderer-related information may be predefined.

Alternatively, or in addition, a user may be allowed to define the renderer-related information, for example, which kind of the renderer is used, the specific rendering scheme, and/or the speaker layout. It would be appreciated that sometimes even no specific parameters for the configuration of a renderer is obtained, it is still possible to estimate the possible rendering behavior of the renderer so as to determine the renderer-aware perceptual differences between audio objects.

Figure 3:
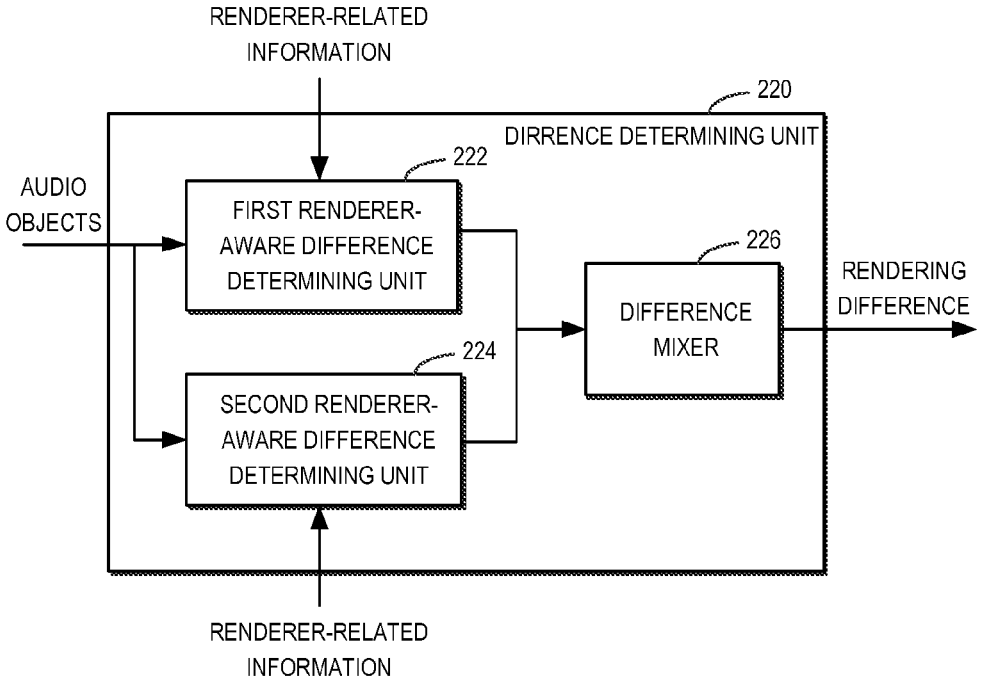
FIG. 3 is a block diagram of the difference determining unit in the system of FIG. 2 in accordance with an example embodiment disclosed herein.

In some embodiments, with respect to different renderer-related information for different renderers, the difference determining unit 220 may determine different renderer-aware perceptual differences with respect to those renderers and then provide a final rendering difference to be used in the clustering process by combining the determined perceptual differences. FIG. 3 shows an example structure of the difference determining unit 220. As shown, the difference determining unit 220 includes a first renderer-aware difference determining unit 222, a second renderer-aware difference determining unit 224, and a difference mixer 226. In some embodiments, the first renderer-aware difference determining unit 222 may be configured to determine a speaker renderer-aware perceptual difference based on the speaker renderer-related information while the second renderer-aware difference determining unit 224 is configured to determine a headphone renderer-aware perceptual difference based on the headphone renderer-related information. The difference mixer 226 may be configured to weight the perceptual differences determined by the units 222 and 224. The determination of a speaker renderer-aware perceptual difference and a headphone renderer-aware perceptual difference will be discussed in detail below.

Speaker Renderer-Aware Perceptual Difference

As discussed above, speaker renderer-related information for a speaker renderer may indicate a reference speaker layout indicating speakers in difference positions and a predefined rendering scheme. Based on the speaker renderer-related information, the first renderer-aware difference determining unit 222 may be configured to estimate rendering behaviors of input audio objects with respect to the speaker renderer and then measure the rendering difference between difference audio objects based on the estimated rendering behaviors.

In some embodiments, to measure a headphone renderer-aware perceptual difference between an audio object k (a first audio object) and an audio object m (a second audio object), the first renderer-aware difference determining unit 222 may determine a set of object-to-speaker gains for the audio object k and another set of object-to-speaker gains for the audio object m based on the reference speaker layout and the predefined rendering scheme. An object-to-speaker gain may define a proportion of the respective audio object to be rendered to one of the speakers by the speaker renderer based on the predefined rendering scheme. In speaker rendering, if the object-to-speaker gain of an audio object with respect to a speaker is non-zero, then this speaker may be active for this audio object. For an inactive speaker for the audio object, the corresponding object-to-speaker gain may be determined as zero. Generally, the speaker renderer may render an audio object across one or more active speakers with non-zero object-to-speaker gains.

In some embodiments, the renderer-related information may include object-to-speaker gains for different audio objects at different spatial positions which are predetermined based on the reference speaker layout and the corresponding rendering scheme. In this case, the first renderer-aware difference determining unit 222 may identify the object-to-speaker gains for the audio objects k and m based on their spatial positions from the renderer-related information. In some other embodiments, the first renderer-aware difference determining unit 222 may directly estimate the object-to-speaker gains for the audio objects k and m in the reference speaker layout based on the predefined rendering scheme.

In some embodiments, a speaker renderer-aware perceptual difference between the audio objects k and m may be determined by measuring a difference between the two sets of object-to-speaker gains. For example, the speaker renderer-aware perceptual difference may be positively correlated with the difference between the two sets of object-to-speaker gains. That is, the larger the difference between the two sets of object-to-speaker gains, the larger the speaker renderer-aware perceptual difference. In one example, the speaker renderer-aware perceptual difference is equal to the difference between the two sets of object-to-speaker gains, as represented below.

$$D_{spk}(k,m)=\mathrm{diff}(\vec{g}_k,\vec{g}_m) \tag{1}$$

where $D_{spk}(k, m)$ represents a speaker renderer-aware perceptual difference between audio objects k and m, $\vec{g}_k$ and $\vec{g}_m$ represents gain vectors for the audio object k and m, respectively which each include object-to-speaker gains for the respective audio objects, and $\mathrm{diff}(\vec{g}_k, \vec{g}_m)$ represents a difference between the two sets of object-to-speaker gains $\vec{g}_k$ and $\vec{g}_m$. It would be appreciated that the perceptual difference $D_{spk}(k, m)$ may be a multiple of $\text{diff}(\vec{g}_k, \vec{g}_m)$ in some other examples.

In some embodiments, the difference between the two sets of object-to-speaker gains $\text{diff}(\vec{g}_k, \vec{g}_m)$ is measured as an Euclidean distance between the two gain vectors $\vec{g}_k$ and $\vec{g}_m$, which may be represented as follows:

$$\text{diff}(\vec{g}_k, \vec{g}_m) = \|\vec{g}_k - \vec{g}_m\|_2 \quad (2)$$

where $\| \|_2$ represents a Euclidean norm of $\vec{g}_k$ and $\vec{g}_m$, which is used to determine the Euclidean distance of the two vectors. In one example, the Euclidean norm may be calculated by squaring each of the difference values of corresponding elements in the vectors, summing the squaring results, and then extracting the root of the sum. In some other embodiments, the difference between the two sets of object-to-speaker gains $\text{diff}(\vec{g}_k, \vec{g}_m)$ may be measured in many other ways and the scope of the subject matter disclosed herein is not limited in this regard.

In some other embodiments, the first renderer-aware difference determining unit 222 may determine the speaker renderer-aware perceptual difference based on active speaker sets of the two audio objects. For a speaker playback system, the rendering space (defined by the speakers in the system) may be divided in to several rendering speaker zones since audio objects in different spatial positions may be rendered to different sets of active speakers. A rendering speaker zone for an audio object may include one or more active speakers to which the audio object is rendered with non-zero gains.

During the audio clustering, it is possible that two audio objects in different rendering speaker zones are combined together as a cluster to be rendered in (only) one of the speaker zones, and then some active speakers of the other speaker zone become inactive after clustering. To avoid this situation, a potential method is to incorporate the speaker zone information in the speaker renderer-aware perceptual difference. For example, if the objects are in different rendering speaker zones, then the perceptual difference may be increased correspondingly so as to ensure decreasing the probability of combing the objects in a cluster.

To determine whether the audio objects k and m are rendered in the same speaker zone or different speaker zones, in some embodiments, the first renderer-aware difference determining unit 222 may identify a first active speaker set for the audio object k, which may include at least one of the speakers (in the reference speaker layout) to which the audio object k is rendered with a non-zero object-to-speaker gain. A second active speaker set may also be identified in a similar manner by the unit 222 for the audio object m. The first renderer-aware difference determining unit 222 may then determine whether the audio objects k and m may be rendered in the same rendering speaker zone by determining whether one of the first and second active speaker sets covers the other one of the first and second active speaker sets. In sum, the same rendering speaker zone may be determined as follows.

$$\Omega(\vec{g}_k \neq 0) \subseteq \Omega(\vec{g}_m \neq 0) \text{ or } \Omega(\vec{g}_m \neq 0) \subseteq \Omega(\vec{g}_k \neq 0) \quad (3)$$

where $\Omega(\vec{g}_k \neq 0)$ represents an active speaker set for the audio object k including only speakers with non-zero object-to-speaker gains, $\Omega(\vec{g}_m \neq 0)$ represents an active speaker set for the audio object m including only speakers with non-zero object-to-speaker gains. Equation (3) indicates that if the active speaker set $\Omega(\vec{g}_k \neq 0)$ is included in the set $\Omega(\vec{g}_m \neq 0)$ or if active speaker set $\Omega(\vec{g}_m \neq 0)$ is included in the set $\Omega(\vec{g}_k \neq 0)$, which means that the rendering speaker zone for the audio object k is totally covered by that for the audio object m or the reverse, then it is determined that the audio objects k and m may be rendered in the same rendering speaker zone.

If the audio objects k and m is determined to be rendered in the same rendering speaker zone, the first renderer-aware difference determining unit 222 may determine that the rendering difference (or perceptual difference) between the two audio objects k and m is small. Otherwise, the rendering difference between the two audio objects k and m may be increased. In some examples, the speaker renderer-aware perceptual difference $D_{spk}(k, m)$ may be determined based on both the difference between the sets of object-to-speaker gains $\text{diff}(\vec{g}_k, \vec{g}_m)$ and the rendering speaker zones of audio objects as follows.

$$D_{spk}(k,m) = \text{diff}(\vec{g}_k, \vec{g}_m) * Z_{spk}(k,m) \quad (4)$$

where $Z_{spk}(k, m)$ represents a function based on the determining of whether the audio objects k and m are to be rendered in the same speaker zone. It would be appreciated that in some other examples, the speaker renderer-aware perceptual difference $D_{spk}(k, m)$ may be determined by $Z_{spk}(k, m)$ only.

In some examples, the function $Z_{spk}(k, m)$ may be provided with a smaller value (for example, a value of 1) if it is determined that the objects k and m are to be rendered in the same speaker zone and with a higher value (for example, a value larger than 1) if it is determined that the objects k and m are not to be rendered in the same speaker zone. In one example, $Z_{spk}(k, m)$ may be represented as follows.

$$Z_{spk}(k, m) = \begin{cases} 1, & \text{if the objects } k \text{ and } m \text{ are in the same speaker zone} \\ \varphi, & \text{otherwise} \end{cases} \quad (5)$$

where φ is a value larger than 1. It would be appreciated that $Z_{spk}(k, m)$ may also be assigned with a value larger than or smaller than one if it is determined that the objects k and m are to be rendered in the same rendering speaker zone. The value φ of the $Z_{spk}(k, m)$ may be set as larger than the value set when the objects k and m are rendered in the same speaker zone.

Headphone Renderer-Aware Perceptual Difference

As discussed above, headphone renderer-related information may indicate a predefined rendering scheme for the headphone renderer. The rendering scheme may indicate how to render a sound source by applying a filter to represent or simulate the acoustic transfer from the sound source to a human ear. Based on the headphone renderer-related information, the second renderer-aware difference determining unit 224 may be configured to estimate rendering behaviors of input audio objects with respect to the headphone renderer and then measure the rendering difference between difference audio objects based on the rendering behaviors.

In some embodiments, to measure a headphone renderer-aware perceptual difference between an audio object k and an audio object m, the second renderer-aware difference determining unit 224 may determine a first filter for rendering the audio object k by the headphone renderer based on the predefined rendering scheme. The second renderer-aware difference determining unit 224 may also determine a second filter for rendering the audio object m by the headphone renderer based on the same rendering scheme. In some examples, the first and second filters (also referred to as HRTF filters) may be constructed by coefficients of HRTFs for sound sources of the audio objects k and m at their respective spatial positions. Generally, a filter determined by the headphone renderer for an audio object is based on an angle or direction of the audio object relative to a head of the listener (the manikin used for determining the HRTFs for example). Therefore, the spatial positions of the audio objects k and m included in their metadata may be used to determine the angles of the spatial positions of the audio objects and the angles may in turn be used to construct the corresponding filters.

In some embodiments, the obtained rendering scheme may include a plurality of predefined filters for sound sources at different spatial positions (or different directions). Then the second renderer-aware difference determining unit 224 may identify the first and second filters from the rendering scheme based on the spatial positions (or directions) of the objects.

The headphone renderer-aware perpetual difference between the two audio objects may be then determined based on the first and second filters, for example, by measuring a difference between rendered outputs of the first and second filters. In some examples, the difference of rendered outputs may be measured by a filtering difference between the first and second filters. The headphone renderer-aware perceptual difference may be positively correlated with the filtering difference between the two HRTF filters. That is, the larger the filtering difference, the larger the perceptual difference. In some examples, the perceptual difference is equal to the filtering difference, as represented below.

$$D_{hp}(k,m)=\mathrm{diff}(\vec{f}_k,\vec{f}_m) \tag{6}$$

where $D_{hp}(k, m)$ represents a headphone renderer-aware perceptual difference between audio objects k and m, $\vec{f}_k$ represents a HRTF filter for the audio object k, $\vec{f}_m$ represents a HRTF for the audio object m, and $\mathrm{diff}(\vec{f}_k, \vec{f}_m)$ represents a filtering difference between $\vec{f}_k$ and $\vec{f}_m$. It would be appreciated that the perceptual difference $D_{hp}(k, m)$ may be a multiple of the filtering difference $\mathrm{diff}(\vec{f}_k, \vec{f}_m)$.

In an example embodiment, the filtering difference $\mathrm{diff}(\vec{f}_k, \vec{f}_m)$ is measured by determining a difference between the spectrums of the first and second filters. For example, the filtering difference $\mathrm{diff}(\vec{f}_k, \vec{f}_m)$ may be determined as a Euclidean norm of the spectrums of the two filters, which may be represented as follows.

$$\mathrm{diff}(\vec{f}_k,\vec{f}m)=\|\mathrm{spec}(\vec{f}_k-\mathrm{spec}(\vec{f}_m)\|_2 \tag{7}$$

where $\mathrm{spec}(\vec{f}_k)$ and $\mathrm{spec}(\vec{f}_m)$ represent spectrum vectors of the filters $\vec{f}_k$ and $\vec{f}_m$ at difference frequency bands respectively, and $\| \|_2$ represents a Euclidean norm of the spectrum vectors. In one example, the Euclidean norm may be calculated by squaring each of the difference values of corresponding elements in the spectrum vectors, summing the squaring results, and then extracting the root of the sum. It would be appreciated that the filtering difference of two filters may be measured in many other ways, for example, by determining a difference between the filter coefficients of the first and second filters.

In some embodiments, the first and second filters determined for the audio objects k and m may be any of filters representing the prorogation processes from the sound sources to the left human ear or filters representing prorogation processes from the sound sources to the right human ear. In one example, two filters for the left and right human ears may be determined for each of the audio objects k and m. In this case, the headphone renderer-aware perceptual difference for the audio objects k and m may be a weighted difference of a first headphone renderer-aware perceptual difference between the two filters for the left human ear and a second headphone renderer-aware perceptual difference between the two filters for the right human ear. In some other examples, since the filters for the left and right human ears may be similar for a specific sound source, only one of the filters may be estimated for an audio object and used for determining the headphone renderer-aware perceptual difference.

In some embodiments, since the HRTF filters may be varied depending on the angels of the audio objects, the headphone renderer-aware perceptual difference may be alternatively or additionally determined based on an angular difference between the angles of the audio objects k and m. As mentioned above, an angle of an audio object at a specific spatial position may be measured with respect to a head of the listener. The headphone renderer-aware perceptual difference may be positively correlated with the angular difference. In some embodiments, the angular difference may be measured based on a difference between azimuth and/or elevation angles of the audio objects k and m. In some embodiments, the headphone renderer-aware perceptual difference may be determined by weighting the filtering difference and the angular difference in a linear or non-linear manner. Alternatively, the headphone renderer-aware perceptual difference may be determined by the angular difference only.

Combining Renderer-Aware Perceptual Differences

In some embodiments, the renderer-aware perceptual differences determined for different renders may be combined by the difference mixer 226 included in the difference determining unit 220. Two kinds of renderer-aware perceptual differences of audio objects, the speaker renderer-aware perceptual difference and the headphone renderer-aware perceptual difference, are discussed above. These renderer-aware perceptual differences from the units 222 and 224 may be combined together as an overall renderer-aware perceptual difference to be used in the audio clustering process. In some embodiments, the information obtaining unit 210 may obtain renderer-related information for different speaker renderers and/or headphone renderers. In this case, the first renderer-aware difference determining unit 222 may be able to determine a plurality of speaker renderer-aware perceptual differences with respect to the different speaker renderers, and the second renderer-aware difference determining unit 224 may also be able to determine a plurality of headphone renderer-aware perceptual differences with respect to the different headphone renderers.

In some embodiments, all the renderer-aware perceptual differences may be combined with corresponding weights to determine an overall renderer-aware perceptual difference, as follows.

$$D_{ren}(k,m)=\sum_{i=1}^{S}\alpha_i * D_{spk}^{i}(k,m)+\sum_{i=1}^{H}\beta_i * D_{hp}^{i}(k,m) \tag{8}$$

where $D_{ren}(k, m)$ represents the overall renderer-aware perceptual difference between the audio objects k and m, S represents the number of the speaker renderers, H represents the number of the headphone renderers, $D_{spk}^{i}(k, m)$ represents the i-th speaker renderer-aware perceptual difference between the audio objects k and m, $D_{hp}^{i}(k, m)$ represents the i-th headphone renderer-aware perceptual difference between the audio objects k and m, and $\alpha_i$ and $\beta_i$ represent weights for corresponding perceptual differences.

For each combination of a reference speaker layout and a rendering scheme, there may be a different speaker renderer accounted in the number S. Similarly, the number of the headphone renderers H may be determined based on the rendering schemes indicated in the renderer-related information. In some examples, S and H may be larger than or equal to 1. The weights $\alpha_i$ and $\beta_i$ may be preset to any values that are smaller than 1. In one example, $\alpha_i$ may be set as equal to 1/S, while $\beta_i$ may be set as equal to 1/H. In other examples, a relative high weight $\alpha_i$ or $\beta_i$ may be set for the perceptual difference determined with respect to a relative import renderer. The scope of the subject matter is not limited in this regard.

It would be appreciated that although the renderer-aware perceptual differences are shown to be linearly weighted in Equation (8), in some other examples, the renderer-aware perceptual differences may be weighted in a non-linear manner. In some other embodiments, the renderer-aware perceptual difference determined with respect to each different renderer may be individually provided to the clustering subsystem 230 to improve the clustering results for this renderer. In these embodiments, the difference mixer 226 in the difference determining unit 220 may be omitted.

As discussed above, a renderer-aware perceptual difference of two audio objects may be used directly in the audio clustering process (for example to replace the traditional spatial difference) or may be used in combination with the spatial difference to represent an overall difference between the two audio objects. In one embodiment, the overall difference between audio objects k and m may be a linearly weighted sum of the renderer-aware perceptual difference and the spatial difference, which may be represented as follows.

$$D(k,m)=\gamma*D_{pos}(k,m)+(1-\gamma)*D_{ren}(k,m) \quad (9)$$

where D (k, m) represents an overall difference between the audio objects k and m, $D_{pos}(k, m)$ represents a spatial difference between the spatial positions of the audio objects k and m, $D_{ren}(k, m)$ represents the renderer-aware perceptual difference between the audio objects k and m, and $\gamma$ and $(1-\gamma)$ represent weights for the spatial difference $D_{pos}(k, m)$ and the renderer-aware perceptual difference $D_{ren}(k, m)$, respectively. In some embodiments, $\gamma$ may range from 0 to 1. For example, $\gamma$ may have a value of 0.3, 0.5, or 0.7. In some other examples, $\gamma$ may be in any other range of values and the scope of the subject matter is not limited in this regard. In the case where $\gamma$ is equal to 0, only the renderer-aware perceptual difference $D_{ren}(k, m)$ is used in the audio clustering process to represent a difference between the audio objects k and m. The determining of the overall difference D (k, m) may be performed by the difference determining unit 220 or the clustering subsystem 230.

The renderer-aware perceptual difference and the overall difference between two audio objects are discussed above. It would be appreciated that the renderer-aware perceptual difference and/or the overall difference of each two of some or all of the input audio objects may be determined. Therefore, during the audio object clustering, differences of some pairs of the input audio objects may be represented by the renderer-aware rendering differences or a combination of the rendering and spatial differences while differences of the other pairs of the audio objects may be still represented by the spatial differences.

The use of the renderer-aware perceptual difference may improve the audio object clustering process in the clustering subsystem 230. In many existing audio clustering methods that can be employed by the clustering subsystem 230, the spatial difference between two audio objects may be taken as an important factor to determine whether two audio objects are clustered in one cluster or in different clusters. Generally, the number of output clusters may be predetermined, which may be a number larger than 1. The typical process of the audio object clustering may include two major stages. The first stage is to determine the cluster positions for the predetermined number of output clusters. The second stage is to determine the gains for clustering the input audio objects into the output clusters at the cluster positions. Those gains may also be referred to object-to-cluster gains. An object-to-cluster gain may define a proportion of the respective audio object to be allocated to an output cluster associated with one of the determined cluster positions.

Figure 4:
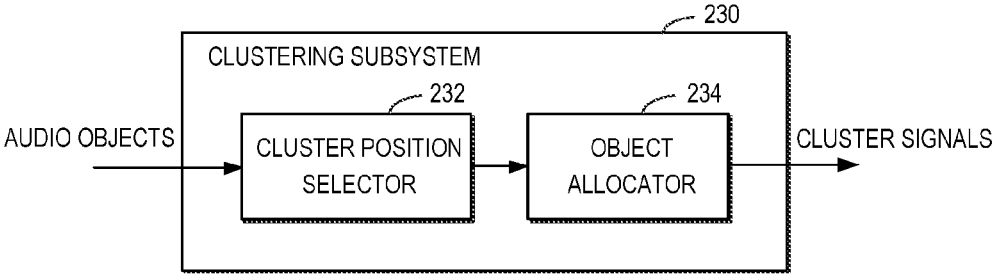
FIG. 4 is a block diagram of a traditional clustering subsystem.

FIG. 4 depicts a traditional clustering subsystem 230, which includes a cluster position selector 232 and an object allocator 234. The cluster position selector 232 may be configured to determine cluster positions for output clusters. In some embodiments, the cluster position selector 232 may select a number of audio objects from the input audio objects based on the importance of the audio objects and/or a spatial distribution of the audio objects. Then the spatial positions of the selected audio objects may be regarded as those of the cluster signals. The number of the selected audio objects may be equal to or less than the predetermined number of the cluster signals. Alternatively, or in addition, the cluster position selector 232 may also determine the cluster positions as some positions other than the positions of the audio objects. For example, a cluster may be determined as being located between two audio objects.

The object allocator 234 may be configured to determine the object-to-cluster gains for the input audio objects based on the determined cluster positions. In the traditional audio object clustering, the determining of the object-to-cluster gains may be based on the spatial proximity between the spatial positions of the audio objects and the cluster positions. If an audio object is closer to a cluster position, a higher gain with respect to the cluster at this position may be assigned to this object. Otherwise, the gain may be smaller or may possibly be zero. For an audio object at the position of a cluster, it may be fully combined in this cluster with an object-to-cluster gain of 1.

In example embodiments disclosed herein, it is described to improve the traditional audio object clustering process by the use of the renderer-aware perceptual difference. In some embodiments, the renderer-aware perceptual difference may be introduced to any of the stages in the clustering process that are related to the spatial distance of audio objects. In some examples, the renderer-aware perceptual difference may be used to estimate some metrics to control some components of the clustering process. Some example usages of the renderer-aware perceptual difference are described for illustration in detail below.

Figure 5:
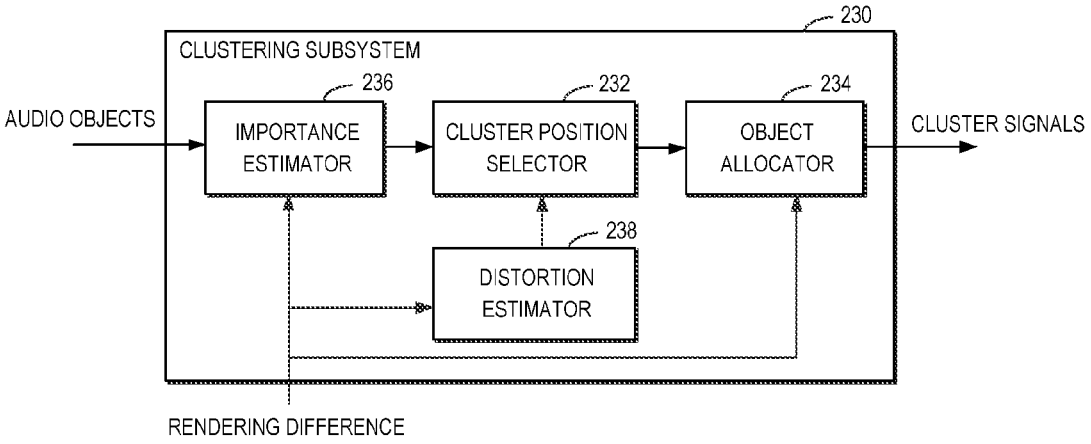
FIG. 5 is a block diagram of a clustering subsystem in the system of FIG. 2 in accordance with an example embodiment disclosed herein.

FIG. 5 depicts an example clustering subsystem 230 with the use of the perceptual difference in accordance with an example embodiment disclosed herein. As shown, in addition to the cluster position selector 232 and the object allocator 234, the clustering subsystem 230 may further include an importance estimator 236 and a distortion estimator 238. The importance estimator 236 may be configured to determine the relative importance of each input audio object based on the renderer-aware perceptual difference to guide the cluster position selection in the cluster position selector 232. More specifically, an audio object with a high (perceptual) importance among all the objects may be favored over objects with low importance in terms of cluster position selection.

The distortion estimator 238 may be configured to determine a distortion of different manners for cluster position selections based on the renderer-aware perceptual difference, so as to control the cluster position selector 232 to determine cluster positions with a relative low rendering distortion. The object allocator 234 may be configured to determine the object-to-cluster gains based on the renderer-aware perceptual difference after the cluster positions are determined.

In some embodiments, the relative importance of an audio object may be determined by the importance estimator 236 based on the partial loudness of the audio object (and the content type of the audio object). Some additional or alternative metrics may be used to quantifying the relative importance, such as one or more of the energy, loudness, and content type of the audio object. With regard to the partial loudness, the perceived loudness of an audio object is usually masked in the context of other audio objects. For example, an audio object may be (partially) masked by other audio objects and/or bed channels present in the scene. In an example embodiment, the audio object with a high partial loudness is favored over objects with a low partial loudness during the cluster position selection. Thus, relatively unmasked (i.e., perceptually louder) audio objects may be less likely to be clustered while relatively masked audio objects are more likely to be clustered.

In some embodiments, in order to determine the partial loudness of an audio object, a masking degree of an input audio object with respect to another input audio object may be determined. Traditionally, the masking degree is determined simply based on a spatial distance between the two audio objects, where the masking degree is positively correlated to the spatial distance. Different from the determining of the masking degree based on the spatial difference only in the traditional method, in some example embodiments disclosed herein, the masking degree may be determined based on the renderer-aware perceptual difference (or the overall difference based on both the renderer-aware perceptual difference and the spatial difference).

The partial loudness of the audio object may be determined based on the masking degrees of this audio object relative to the other input audio objects. In an embodiment, the partial loudness may be determined for difference critical bands. It is assumed that there are K audio objects (k=1, . . . , K) with excitation levels $E_k(b)$ in a critical band b, the partial loudness $N'_k(b)$ of the audio object k may be determined based on the excitation levels $E_k(b)$ of the input audio objects and the masking degree of each pair of audio objects k and m. In an example, the partial loudness $N'_k(b)$ for the audio object k in the band b may be positively correlated with the masking degree. That is, the higher the masking degree, the larger the partial loudness $N'_k(b)$.

In the traditional cases where the masking degree is determined based on the spatial difference, the partial loudness $N'_k(b)$ may be determined as follows.

$$N'_k(b) = \left(A + \sum_{m=1}^{K} E_m(b)\right)^{\alpha} - \left(A + \sum_{m=1}^{K-1} E_m(b)(1 - f_{pos}(k, m))\right)^{\alpha} \tag{10-1}$$

where $E_m(b)$ represents the excitation level of the audio object m in the critical band b, $f_{pos}(k, m)$ represents a masking degree of the audio object k relative to the audio object m, and A and $\alpha$ represent modeled parameters, respectively. The term $\Sigma_{m=1}^{K} E_m(b)$ in Equation (10) may represent the overall excitation of the auditory scene of the input audio objects. The term $\Sigma_{m=1}^{K-1} E_m(b)\,(1-f_{pos}(k, m))$ in Equation (10) may reflect the overall excitation except for the audio object k and thus may be interpreted as a "masking" term that applies to the audio object k. In some examples, A may be set as a value of 1, and a may be set as a value of 0.2. In some other examples, A and $\alpha$ may be set as any other values such as 2 and 0.3, 3 and 0.5, or the like.

When the renderer-aware perceptual difference is available, when determining the partial loudness, the spatial distance-based masking degree may be replaced by the renderer-aware perceptual difference-based masking degree (denoted as "$f_{ren}(k, m)$"). Equation (10-1) may then be rewritten as follows.

$$N'_k(b) = \left(A + \sum_{m=1}^{K} E_m(b)\right)^{\alpha} - \left(A + \sum_{m=1}^{K-1} E_m(b)(1 - f_{ren}(k, m))\right)^{\alpha} \tag{10-2}$$

where $f_{ren}(k, m)$ represents a masking degree of the audio object k with respect to the audio object m.

The masking degree $f_{ren}(k, m)$ may be a function of the renderer-aware perceptual difference. Generally, the masking degree $f_{ren}(k, m)$ of the audio object k with respect to the audio object m may be equal to the masking degree $f_{ren}(m, k)$ of the audio object m with respect to the audio object k. In some embodiments, the masking degree may be negatively correlated with the renderer-aware perceptual difference. For example, the masking degree $f_{ren}(k, m)$ have a value that is equal to 1 if the perceptual difference between the audio objects k and m is zero and is decreasing to 0 with increasing perceptual difference. If the renderer-aware perceptual differences of the audio object k with respect to all other input audio objects are relative small, the masking degrees may be relative high and thus the resulting partial loudness of the audio object k is higher.

In some other embodiments, the masking degree of two audio objects may be determined based on both the spatial difference and the renderer-aware perceptual difference. For example, a first masking degree $f_{ren}(k, m)$ based on the renderer-aware perceptual difference may be multiplied with a second masking degree $f_{pos}(k, m)$ based on the spatial difference and the multiplication result may be used to determine the partial loudness. As such, the determining of the partial loudness may be represented as follows.

$$N'_k(b) = \left(A + \sum_{m=1}^{K} E_m(b)\right)^{\alpha} - \left(A + \sum_{m=1}^{K-1} E_m(b)(1 - f_{pos}(k, m) * f_{ren}(k, m))\right)^{\alpha} \tag{11}$$

In some other examples, the masking degrees $f_{pos}(k, m)$ and $f_{ren}(k, m)$ may be weighted to provide a summed masking degree to be used in determining the partial loudness. Alternatively, an overall masking degree f (k, m) may be determined based on the overall difference D(k, m) in Equation (9) and then used to determine the partial loudness (for example, by replacing the term $f_{pos}(k, m)*f_{ren}(k, m)$) in Equation (11)). The scope of the subject matter is not limited in the scope.

A relative importance of an audio object may be determined as positively correlated with the partial loudness of the audio object in a critical band (or the partial loudness in all critical bands). For example, the relative importance may be measured as being equal to the partial loudness or may be a multiple of the partial loudness. As mentioned above, other factors related to the audio object may be alternatively or additionally accounted in the relative importance. In the cluster position selector 232, cluster positions for the predetermined number of clusters may be determined based on the relative importance of the input audio objects. For example, as mentioned above, an audio object with large relative importance may be favored over audio objects with small relative importance in term of cluster position selection. Therefore, in some embodiments, the cluster positions may be selected as positions of audio objects with larger relative importance.

In some embodiments, to preserve the quality of rendering output clusters and avoid large rendering distortions on the playback systems, audio objects with large contributions to rendering output channels will be favored over audio objects with small contributions to rendering output channels during cluster position selection, especially for the output channels with large rendering distortions. The output channels may include channels corresponding to a plurality of speakers in the speaker playback systems or the channels corresponding to the headphone. In determining the rendering distortions, reference speaker layout(s) and/or reference headphone(s) may be taken into consideration.

In some embodiments, the cluster position selector 232 may first determine a set of initial cluster positions (denoted as "C") and then the distortion estimator 238 may estimate a rendering distortion (denoted as "$d_o(C)$") for the initial cluster positions. The rendering distortion $d_o(C)$ may be used to update the cluster positions determined by the cluster position selector 232. In some embodiments, the rendering distortion may be measured by rendering of the audio objects to output channels by a potential renderer and rendering of the initial cluster signals to the output channels by the renderer.

More specifically, the rendering distortion may be determined by a ratio (denoted as "$r_o(C)$") of audio objects which can be correctly rendered to the output channels by the initial cluster positions. In some examples, the rendering distortion $d_o(C)$ may be determined as follows.

$$d_o(C) = F(r_o(C)) \tag{12}$$

$$r_o(C) = \frac{\sum_{k=1}^{K} \sum_{c=1}^{Q} g_{c,o}^2 * E_{k,c}}{\sum_{k=1}^{K} g_{k,o}^2 * E_k} \tag{13}$$

where F( ) represents a decreasing function with respect to the ratio $r_o(C)$ and may have a higher value with the ratio $r_o(C)$ decreasing, K represents the number of input audio objects, $E_k$ represents the excitation level of the audio object k in a full frequency band range or a specific band of the audio object k, $E_{k,c}$ represents the excitation level of the audio object k on an initial cluster c (with c=1, . . . , Q), Q is the number of the initial clusters in the set C, $g_{c,o}$ represents a cluster-to-channel gain for rendering the initial cluster c to the output channel o, and $g_{k,o}$ represents an object-to-channel gain for rendering the audio object k to the output channel o.

The ratio $r_o(C)$ may be used to represent a rendering difference between rendering the audio objects to the output channels and rendering initial cluster signals at the initial cluster positions to the output channels. The initial cluster signals may be generated by clustering the input audio objects based on the initial cluster positions C. In some cases of the headphone renders, the ratio $r_o(C)$ may be alternatively determined based on the rendering difference between rendering the audio objects to the output channels of a headphone and rendering the initial cluster signals C to the output channels.

In some embodiments, the initial cluster positions C may be initialized by the cluster position selector 232 for all the predetermined number of clusters. In some other embodiments where the cluster position selector 232 selects the cluster positions sequentially, the initial cluster positions may include a position for one of the predetermined number of clusters and may be expanded to include more cluster positions by performing the updating process. As mentioned above, the cluster positions may be the exact positions of the audio objects or any other positions between the audio objects.

In some embodiments, the excitation level $E_{k,c}$ of the audio object k on a cluster c may be determined based on the object-to-cluster gain, which may be represented as follows.

$$E_{k,c}=g_{k,c}^2*E_k \tag{14}$$

where $g_{k,c}$ represents an object-to-cluster gain for rendering the audio object k to the cluster c. Alternatively, or in addition, the masking degree between the audio object k and the cluster c may be taken into account in determining $E_{k,c}$. The masking degree may be determined based on the renderer-aware perceptual difference between the audio object k and the cluster c and/or the spatial difference between the audio object k and the cluster c. In some examples where the positions of the audio objects are selected for the cluster positions, the renderer-aware perceptual difference between the audio object k and the cluster c may already be determined by the difference determining unit 220. In some other examples, the renderer-aware perceptual difference between the audio object k and the cluster c may be determined in a manner as described above by regarding the cluster c as an audio object.

In some embodiments where the cluster positions are sequentially selected by the cluster position selector 232, the cluster positions may be updated sequentially by incorporating a new cluster. Each time a new cluster position is selected, the excitation level $E_k$ for an audio object k may be first updated by removing the excitation level of the object k masked by the previous selected cluster c−1, which may be represented as follows.

$$E'_k=E_k-E_{k,c-1} \tag{15}$$

where $E'_k$ represents the updated excitation level, $E_k$ represents the previous excitation level, and $E_{k,c-1}$ represents the excitation level of the audio object k masked by the previous selected cluster c−1. The initial value $E_{k,0}$ may be set to be 0.

The excitation level of the audio object k on the current selected cluster position c may be determined based on a masking degree between the audio object k and the cluster at the selected cluster position c, which may be represented as follows.

$$E'_{k,c}=f_{ren}(k,c)*E'_k \tag{16}$$

where $E'_{k,c}$ represents an excitation level of the audio object k on the cluster c, $f_{ren}(k, c)$ represents a masking degree of the audio object k with respect to the selected cluster c. The masking degree $f_{ren}(k, c)$ may be determined based on a render-aware perceptual difference between the audio object k and the cluster c.

During the updating process, the updated excitation levels $E'_k$ and $E'_{k,c}$ may be used to update the rendering distortion by using Equations (12) and (13). Based on the updated rendering distortion, the cluster position selector 232 may select the next cluster position to put it into the cluster position set C. The set of cluster positions C may be continuously updated until the predetermined number of cluster positions are selected.

In some embodiments, based on the rendering distortion, a rendering importance of an audio object for the quality of output channels may be determined. This rendering importance may be different from the relative importance of the audio object determined based on the partial loudness with respect to other audio objects. This importance may be further used to guide the cluster position selection. Generally, to avoid large distortion on some output channels, channels with large distortions may have large weights while calculating the importance. In one embodiment, the importance of the audio object k to the quality of output channels may be determined by multiplying the object-to-channel gains of this audio object k with the rendering distortion on different output channels.

In some examples, the determining of the rendering importance (denoted as "$I_k$") may be determined as follows:

$$I_k=\vec{g}_k^{\,T}*\vec{d} \tag{17}$$

where $\vec{g}_k=[g_{k1}, g_{k2}, \ldots, g_{kO}]$ represents a gain vector for rendering the audio object k to the output channels and may include O elements $g_{kO}$ for respective O output channels, and $\vec{d}=(d_1, d_2, \ldots, d_O)$ represents a rendering distortion vector determined for the O output channels and may include O elements $d_o$ for respective O output channels. The distortion $d_o$ may be determined by using Equation (12) and (13). It can be seen from Equation (17) that if the audio object k has large gains with respect to some of the channels while the rendering distortions on these channels are large, than the importance of the audio object may be large. During the cluster position selection, audio objects with large rendering importance may be favored over objects with small rendering importance during cluster position selection.

In some embodiments, in addition to the partial loudness, the relative importance for the audio object may be further determined based on the rendering importance $I_k$. In one embodiment, the rendering importance $I_k$ may be used to update the partial loudness of the audio object k. For example, the partial loudness of the audio object k in a critical band b may be updated by multiplying the partial loudness calculated by Equation (10) or (11) with the rendering importance $I_k$, which may be represented as follows.

$$N''_k(b)=N'_k(b)*I_k \tag{18}$$

where $N''_k(b)$ represents the updated partial loudness. The updated partial loudness $N''_k(b)$ may then be used to update the relative importance determined in the importance estimator 236. It would be appreciated that the relative importance may be alternatively based on the rendering importance $I_k$ instead of the partial loudness.

Still referring to FIG. 5, the object allocator 234 may determine object-to-cluster gains for the input audio objects based on the cluster positions. In some embodiments, the determining of the object-to-cluster gains may further based on the renderer-aware perceptual differences (or the overall differences) between the input audio objects. In many existing object allocation methods, an object may be allocated to the clusters by adding the object to its closest neighboring cluster position or mixing the object into some or all of the clusters by means of triangulation, using vector decomposition, or any other means to minimize the spatial error of the object. All existing object-to-cluster allocation methods are based on the spatial differences (or spatial distances) between the objects and the clusters. To improve the performance on playback side, in some embodiments, the renderer-aware perceptual difference (or the overall difference based on both the perceptual difference and the spatial difference) may be directly used to replace the traditional spatial difference in the allocation process.

A detailed example for the cluster allocation is given below for the purpose of illustration. In some existing object allocation methods, one method to determine the object-to-cluster gains is to minimize an overall cost function. The overall cost function may be related to a cost function of the distance between the audio object position and the cluster position. The overall cost function may also be related to a cost function of the spatial location of an object after distributing its signal across the clusters, and another cost function of the gain or loss of energy.

To avoid an audio object k being represented by a cluster far away from its object position, the cost function of the distance between the audio object position and the cluster position may be determined by multiplying the object-to-cluster gains and the spatial distance between the audio object and the cluster, which may be represented as follows.

$$C_D=\sum_{c=1}^{C} g_{k,c}^2 D_{pos}^2(k, c) \tag{19}$$

where $C_D$ represents the cost function, C represents the number of clusters; $g_{k,c}$ represents an object-to-cluster gain to be determined by the object allocator 234 for rendering the audio object k to the cluster c, and $D_{pos}(k, c)$ represents a spatial distance between the audio object k and the cluster position of the cluster c determined by the cluster position selector 232.

In embodiments disclosed herein, with the renderer-aware perceptual difference between two audio objects determined, the cost function in Equation (19) may be rewritten by replacing the spatial distance with the renderer-aware perceptual difference, which may be represented as follows.

$$C_D=\sum_{c=1}^{C} g_{k,c}^2 D_{ren}^2(k, c) \tag{20}$$

where $D_{ren}(k, c)$ represents the renderer-aware perceptual difference between the audio object k and the cluster c. The renderer-aware perceptual difference $D_{ren}(k, c)$ may be determined by Equation (8), for example. In some examples where the cluster position of the cluster c is the spatial position of an audio object, $D_{ren}(k, c)$ may be already determined by the difference determining unit 220. It can be seen from Equation (20) that when the renderer-aware perceptual differences between the audio object k and some clusters are small, then the object-to-cluster gains may be determined as large value so that the value of the cost function $C_D$ may be reduced or minimized.

It would be appreciated that the above example is given for the purpose of illustration and the perceptual differences between audio objects may be employed in various other aspects of the object allocation.

Figure 6:
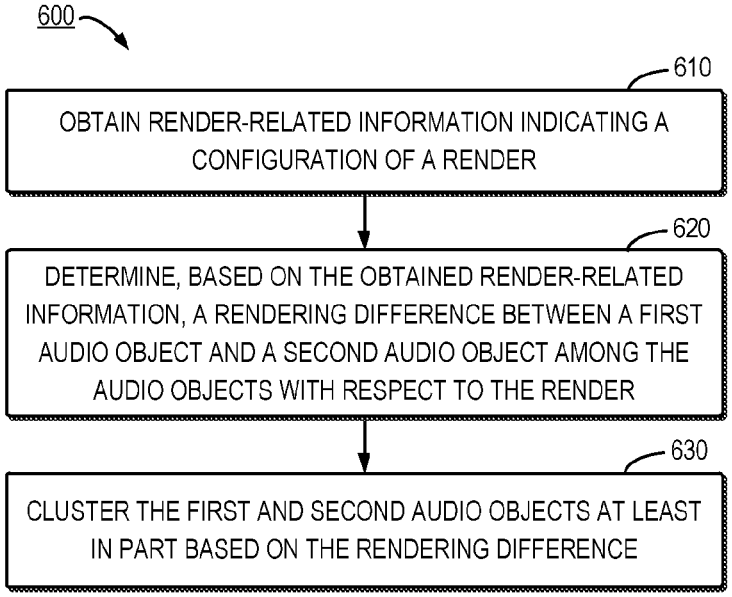
FIG. 6 is a flowchart of a process of processing audio objects in accordance with an example embodiment disclosed herein.

FIG. 6 depicts a flowchart of a process of processing audio objects 600 in accordance with one example embodiment disclosed herein. At step 610, renderer-related information is obtained. The renderer-related information indicates a configuration of a renderer. In step 620, a rendering difference between a first audio object and a second audio object among the audio objects with respect to the renderer is determined based on the obtained renderer-related information. In step 630, the first and second audio objects are clustered at least in part based on the rendering difference.

In some example embodiments, the renderer may include a speaker renderer and the renderer-related information may indicate a reference speaker layout indicating speakers at different positions and a predefined rendering scheme for the speaker renderer. In some example embodiments, the rendering difference may be determined by determining a first set of object-to-speaker gains for the first audio object and a second set of object-to-speaker gains for the second audio object based on the reference speaker layout and the predefined rendering scheme, an object-to-speaker gain defining a proportion of the respective audio object to be rendered to one of the speakers by the speaker renderer based on the predefined rendering scheme, and determining the rendering difference based on the first and second sets of object-to-speaker gains.

In some example embodiments, the rendering difference may be determined as being positively correlated with a difference between the first and second sets of object-to-speaker gains.

In some example embodiments, the rendering difference may be further determined by identifying a first active speaker set including at least one of the speakers to which the first audio object is rendered with a non-zero object-to-speaker gain in the first set and identifying a second active speaker set including at least one of the speakers to which the second audio object is rendered with a non-zero object-to-speaker gain in the second set, and determining the rendering difference further based on determining whether one of the first and second active speaker sets covers the other one of the first and second active speaker sets.

In some example embodiments, the renderer may include a headphone renderer and the renderer-related information may indicate a predefined rendering scheme for the headphone renderer. In some example embodiments, the rendering difference may be determined by determining, based on the predefined rendering scheme, a first filter for rendering the first audio object by the headphone renderer and a second filter for rendering the second audio object by the headphone renderer; and determining the rendering difference based on the first and second filters.

In some example embodiments, the rendering difference may be further determined by determining the rendering difference further based on an angular difference between spatial positions of the first and second audio objects.

In some example embodiments, the rendering difference may be determined by determining the rendering difference based on a difference between a first spectrum of the first filter and a second spectrum of the second filter.

In some example embodiments, the audio objects may be clustered by clustering the audio objects by using the rendering difference in place of a spatial distance between the first and second audio objects or in combination with the spatial distance.

In some example embodiments, the audio objects may be clustered by measuring a masking degree of the first and second audio objects with respect to each other based on the rendering difference; determining, based on the masking degree, first partial loudness of the first audio object and second partial loudness of the second audio object among the audio objects; and clustering the audio objects based on the first and second partial loudness.

In some example embodiments, the audio objects may be clustered by determining cluster positions based on the first and second partial loudness; and determining, based on the cluster positions, object-to-cluster gains for the audio objects, an object-to-cluster gain defining a proportion of the respective audio object to be allocated to a cluster signal associated with one of the determined cluster positions; and clustering the audio objects based on the object-to-cluster gains.

In some example embodiments, the cluster positions may be determined by determining initial cluster positions; generating initial cluster signals by clustering the audio objects based on the initial cluster positions; measuring, at least in part based on the first and second partial loudness, a rendering distortion between rendering of the audio objects to output channels by the renderer and rendering of the initial cluster signals to the output channels by the renderer; and determining the cluster positions for the cluster signals by updating the initial cluster positions based on the rendering distortion.

It is to be understood that the components of the system 200 may be a hardware module or a software unit module. For example, in some embodiments, the system may be implemented partially or completely as software and/or in firmware, for example, implemented as a computer program product embodied in a computer readable medium. Alternatively, or in addition, the system may be implemented partially or completely based on hardware, for example, as an integrated circuit (IC), an application-specific integrated circuit (ASIC), a system on chip (SOC), a field programmable gate array (FPGA), and so forth. The scope of the subject matter disclosed herein is not limited in this regard.

Figure 7:
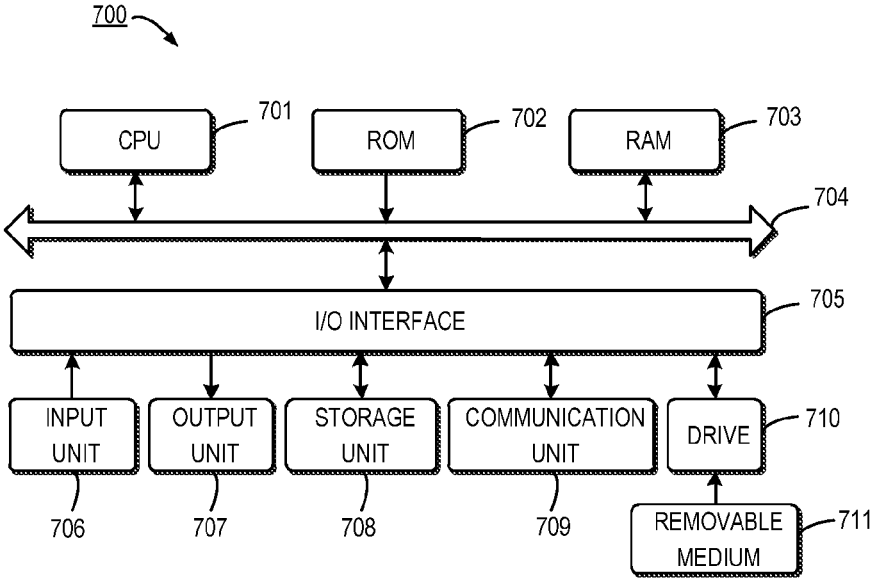
FIG. 7 is a block diagram of an example computer system suitable for implementing example embodiments disclosed herein.

FIG. 7 depicts a block diagram of an example computer system 700 suitable for implementing example embodiments disclosed herein. As depicted, the computer system 700 includes a central processing unit (CPU) 701 which is capable of performing various processes in accordance with a program stored in a read only memory (ROM) 702 or a program loaded from a storage unit 708 to a random access memory (RAM) 703. In the RAM 703, data required when the CPU 701 performs the various processes or the like is also stored as required. The CPU 701, the ROM 702 and the RAM 703 are connected to one another via a bus 704. An input/output (I/O) interface 705 is also connected to the bus 704.

The following components are connected to the I/O interface 705: an input unit 706 including a keyboard, a mouse, or the like; an output unit 707 including a display such as a cathode ray tube (CRT), a liquid crystal display (LCD), or the like, and a loudspeaker or the like; the storage unit 708 including a hard disk or the like; and a communication unit 709 including a network interface card such as a LAN card, a modem, or the like. The communication unit 709 performs a communication process via the network such as the internet. A drive 710 is also connected to the I/O interface 705 as required. A removable medium 711, such as a magnetic disk, an optical disk, a magneto-optical disk, a semiconductor memory, or the like, is mounted on the drive 710 as required, so that a computer program read therefrom is installed into the storage unit 708 as required.

Specifically, in accordance with example embodiments disclosed herein, the process 600 described above with reference to FIG. 6 may be implemented as computer software programs. For example, example embodiments disclosed herein include a computer program product including a computer program tangibly embodied on a machine readable medium, the computer program including program code for performing the process 600. In such embodiments, the computer program may be downloaded and mounted from the network via the communication unit 709, and/or installed from the removable medium 711.

Generally speaking, various example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments disclosed herein are illustrated and described as block diagrams, flowcharts, or using some other pictorial representation, it will be appreciated that the blocks, apparatus, systems, techniques or methods disclosed herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, example embodiments disclosed herein include a computer program product including a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include, but not limited to, an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing.

Computer program code for carrying out methods disclosed herein may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server. The program code may be distributed on specially-programmed devices which may be generally referred to herein as "modules". Software component portions of the modules may be written in any computer language and may be a portion of a monolithic code base, or may be developed in more discrete code portions, such as is typical in object-oriented computer languages. In addition, the modules may be distributed across a plurality of computer platforms, servers, terminals, mobile devices and the like. A given module may even be implemented such that the described functions are performed by separate processors and/or computing hardware platforms.

As used in this application, the term "circuitry" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present. Further, it is well known to the skilled person that communication media typically embodies computer readable instructions, data structures, program modules or other data in a modulated data signal such as a carrier wave or other transport mechanism and includes any information delivery media.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of the subject matter disclosed herein or of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination.

Various modifications, adaptations to the foregoing example embodiments disclosed herein may become apparent to those skilled in the relevant arts in view of the foregoing description, when read in conjunction with the accompanying drawings. Any and all modifications will still fall within the scope of the non-limiting and example embodiments disclosed herein. Furthermore, other embodiments disclosed herein will come to mind to one skilled in the art to which those embodiments pertain having the benefit of the teachings presented in the foregoing descriptions and the drawings.

Accordingly, the present subject matter may be embodied in any of the forms described herein. For example, the following enumerated example embodiments (EEEs) describe some structures, features, and functionalities of some aspects of the subject matter disclosed herein.

EEE 1. A method of processing object-based audio data comprising: determining a renderer-aware perceptual difference of audio objects based on object metadata and a rendering behavior of a renderer; and combining the audio objects into clusters based on the renderer-aware perceptual difference.

EEE 2. The method of EEE 1, the renderer-aware perceptual difference includes at least one of a speaker renderer-aware perceptual difference, where one or more speaker renderers on one or more speaker layouts may be taken into account; and a headphone renderer-aware perceptual difference, where one or more headphone renderers may be taken into account.

EEE 3. The method of EEE 1, the renderer-aware perceptual difference may be used by replacing a spatial distance between audio objects, or combining with the spatial distance.

EEE 4. The method of EEE 2, the speaker renderer-aware perceptual difference of two objects may be calculated based on at least one of the distance of object-to-speaker gains for the audio objects, and the speaker zones of the audio objects.

EEE 5. The method of EEE 4, the speaker zone of the objects may be determined based on the speaker sets where the objects are rendered to.

EEE 6. The method of EEE 2, the headphone renderer-aware perceptual difference of two audio objects may be calculated based on the difference of corresponding HRTF filters.

EEE 7. The method of EEE 1, the method of utilizing renderer-aware perceptual difference in clustering process may include: replacing the spatial distance by the renderer-aware perceptual difference, or combining the spatial distance with the renderer-aware perceptual difference in some or all audio clustering components; and deriving a rendering distortion to steer the clustering process.

EEE 8. The method of EEE 7, the masking amount in partial loudness calculation may be estimated based on the renderer-aware perceptual difference.

EEE 9. The method of EEE 7, the rendering distortion may be estimated based on the renderer-aware perceptual difference to steer the centroids selection process.

EEE 10. The method of EEE 7, the renderer-aware perceptual difference may be used as the distance metric during object-to-cluster gains calculation.

It will be appreciated that the embodiments of the subject matter disclosed herein are not to be limited to the specific embodiments disclosed and that modifications and other embodiments are intended to be included within the scope of the appended claims. Although specific terms are used herein, they are used in a generic and descriptive sense only and not for purposes of limitation.

Various aspects of the present invention may be appreciated from the following new enumerated example embodiments (NEEs).

NEE 1. A method of processing audio objects, comprising:

obtaining renderer-related information indicating a configuration of a renderer;

determining, based on the obtained renderer-related information, a rendering difference between a first audio object and a second audio object among the audio objects with respect to the renderer; and clustering the audio objects at least in part based on the rendering difference. The renderer-related information may indicate a predefined rendering scheme for the renderer, and determining the rendering difference may comprise determining a first vector based on the predefined rendering scheme for the first audio object and a second vector based on the predefined rendering scheme for the second audio object. In addition, determining the rendering difference may further comprise determining the rendering difference based on the first vector and based on the second vector. At this, the first vector and the second vector may represent input signals for the renderer for rendering the audio objects. The elements of the first vector and the second vector may either be object-to-speaker gains or filter coefficients. In particular, the filter coefficients may be filter coefficients of a head related transfer function HRTF.

NEE 2. The method of NEE 1, wherein the renderer includes a speaker renderer and the renderer-related information indicates a reference speaker layout indicating speakers at different positions and a predefined rendering scheme for the speaker renderer, and wherein determining the rendering difference comprises:

determining a first set of object-to-speaker gains for the first audio object and a second set of object-to-speaker gains for the second audio object based on the reference speaker layout and the predefined rendering scheme, an object-to-speaker gain defining a proportion of the respective audio object to be rendered to one of the speakers by the speaker renderer based on the predefined rendering scheme; and determining the rendering difference based on the first and second sets of object-to-speaker gains.

NEE 3. The method of NEE 2, wherein determining the rendering difference based on the first and second sets of object-to-speaker gains comprises:

determining the rendering difference as being positively correlated with a difference between the first and second sets of object-to-speaker gains.

NEE 4. The method of any of NEEs 2 to 3, wherein determining the rendering difference based on the first and second sets of object-to-speaker gains further comprises:

identifying a first active speaker set including at least one of the speakers to which the first audio object is rendered with a non-zero object-to-speaker gain in the first set;

identifying a second active speaker set including at least one of the speakers to which the second audio object is rendered with a non-zero object-to-speaker gain in the second set; and determining the rendering difference further based on determining whether one of the first and second active speaker sets covers the other one of the first and second active speaker sets.

NEE 5. The method of NEE 1, wherein the renderer includes a headphone renderer and the renderer-related information indicates a predefined rendering scheme for the headphone renderer, and wherein determining the rendering difference comprises:

determining, based on the predefined rendering scheme, a first filter for rendering the first audio object by the headphone renderer and a second filter for rendering the second audio object by the headphone renderer; and determining the rendering difference based on the first filter and the second filter.

NEE 6. The method of NEE 5, wherein determining the rendering difference further comprises:

determining the rendering difference further based on an angular difference between spatial positions of the first and second audio objects.

NEE 7. The method of any of NEEs 5 to 6, wherein determining the rendering difference based on the first filter and the second filter comprises:

determining the rendering difference based on a difference between a first spectrum of the first filter and a second spectrum of the second filter.

NEE 8. The method of any of NEEs 1 to 7, wherein clustering the audio objects comprises:

clustering the audio objects by using the rendering difference in place of a spatial distance between the first and second audio objects or in combination with the spatial distance.

NEE 9. The method of any of NEEs 1 to 7, wherein clustering the audio objects comprises:

measuring a masking degree of the first and second audio objects with respect to each other based on the rendering difference;

determining, based on the masking degree, first partial loudness of the first audio object and second partial loudness of the second audio object among the audio objects; and clustering the audio objects based on the first and second partial loudness.

NEE 10. The method of NEE 9, wherein clustering the audio objects based on the first and second partial loudness comprises:

determining cluster positions based on the first and second partial loudness;

determining, based on the cluster positions, object-to-cluster gains for the audio objects, an object-to-cluster gain defining a proportion of the respective audio object to be allocated to a cluster signal associated with one of the determined cluster positions; and clustering the audio objects based on the object-to-cluster gains.

NEE 11. The method of NEE 10, wherein determining the cluster positions comprises:

determining initial cluster positions;

generating initial cluster signals by clustering the audio objects based on the initial cluster positions;

measuring, at least in part based on the first and second partial loudness, a rendering distortion between rendering of the audio objects to output channels by the renderer and rendering of the initial cluster signals to the output channels by the renderer; and determining the cluster positions for the cluster signals by updating the initial cluster positions based on the rendering distortion.

NEE 12. A system for processing audio objects, comprising:

an information obtaining unit configured to obtain renderer-related information indicating a configuration of a renderer;

a difference determining unit configured to determine, based on the obtained renderer-related information, a rendering difference between a first audio object and a second audio object among the audio objects with respect to the renderer; and a cluster subsystem configured to cluster the first and second audio objects at least in part based on the rendering difference. The renderer-related information may indicate a predefined rendering scheme for the renderer, and the difference determining unit may be configured to determine a first vector based on the predefined rendering scheme for the first audio object and a second vector based on the predefined rendering scheme for the second audio object. The difference determining unit may be further configured to determine the rendering difference based on the first vector and based on the second vector. The first vector and the second vector may represent input signals for the renderer for rendering the audio objects. The elements of the first vector and the second vector may either be object-to-speaker gains or filter coefficients. In particular, the filter coefficients may be filter coefficients of a head related transfer function HRTF.

NEE 13. The system of NEE 12, wherein the renderer includes a speaker renderer and the renderer-related information indicates a reference speaker layout indicating speakers at different positions and a predefined rendering scheme for the speaker renderer, and wherein the difference determining unit is configured to:

determine a first set of object-to-speaker gains for the first audio object and a second set of object-to-speaker gains for the second audio object based on the reference speaker layout and the predefined rendering scheme, an object-to-speaker gain defining a proportion of the respective audio object to be rendered to one of the speakers by the speaker renderer based on the predefined rendering scheme; and determine the rendering difference based on the first and second sets of object-to-speaker gains.

NEE 14. The system of NEE 13, wherein the difference determining unit is configured to determine the rendering difference as being positively correlated with a difference between the first and second sets of object-to-speaker gains.

NEE 15. The system of any of NEEs 13 to 14, wherein the difference determining unit is further configured to:

identify a first active speaker set including at least one of the speakers to which the first audio object is rendered with a non-zero object-to-speaker gain in the first set;

identify a second active speaker set including at least one of the speakers to which the second audio object is rendered with a non-zero object-to-speaker gain in the second set; and determine the rendering difference further based on determining whether one of the first and second active speaker sets covers the other one of the first and second active speaker sets.

NEE 16. The system of NEE 12, wherein the renderer includes a headphone renderer and the renderer-related information indicates a predefined rendering scheme for the headphone renderer, and wherein the difference determining unit is configured to:

determine, based on the predefined rendering scheme, a first filter for rendering the first audio object by the headphone renderer and a second filter for rendering the second audio object by the headphone renderer; and determine the rendering difference based on the first filter and the second filter.

NEE 17. The system of NEE 16, wherein the difference determining unit is configured to determine the rendering difference further based on an angular difference between spatial positions of the first and second audio objects.

NEE 18. The system of any of NEEs 16 to 17, wherein the difference determining unit is configured to determine the rendering difference based on a difference between a first spectrum of the first filter and a second spectrum of the second filter.

NEE 19. The system of any of NEEs 12 to 18, wherein the clustering subsystem is configured to cluster the first and second audio objects by using the rendering difference in place of a spatial distance between the first and second audio objects or in combination with the spatial distance.

NEE 20. The system of any of NEEs 12 to 18, wherein the clustering subsystem is configured to:

measure a masking degree of the first and second audio objects with respect to each other based on the rendering difference;

determine, based on the masking degree, first partial loudness of the first audio object and second partial loudness of the second audio object among the audio objects; and cluster the audio objects based on the first and second partial loudness.

NEE 21. The system of NEE 20, wherein the clustering subsystem is configured to:

determine cluster positions based on the first and second partial loudness;

determine, based on the cluster positions, object-to-cluster gains for the audio objects, an object-to-cluster gain defining a proportion of the respective audio object to be allocated to a cluster signal associated with one of the determined cluster positions; and cluster the audio objects based on the object-to-cluster gains.

NEE 22. The system of NEE 21, wherein the clustering subsystem is configured to:

determine initial cluster positions;

generate initial cluster signals by clustering the audio objects based on the initial cluster positions;

measure, at least in part based on the first and second partial loudness, a rendering distortion between rendering of the audio objects to output channels by the renderer and rendering of the initial cluster signals to the output channels by the renderer; and determine the cluster positions for the cluster signals by updating the initial cluster positions based on the rendering distortion.

NEE 23. A computer program product for processing audio objects, comprising a computer program tangibly embodied on a machine readable medium, the computer program containing program code for performing steps of the method according to any of NEEs 1 to 11.

NEE 24. A device for processing audio objects comprising:

a processing unit; and a memory storing instructions that, when executed by the processing unit, cause the device to perform steps of the method according to any of NEEs 1 to 11.

What is claimed is:

1. A method of processing audio objects, comprising:

obtaining renderer-related information indicating a configuration of a renderer;

determining, based on the obtained renderer-related information, a rendering difference between a first audio object and a second audio object among the audio objects with respect to the renderer; and clustering the audio objects at least in part based on the rendering difference.

2. The method of claim 1, wherein the renderer-related information indicates a predefined rendering scheme for the renderer, and wherein determining the rendering difference comprises:

determining a first vector based on the predefined rendering scheme for the first audio object and a second vector based on the predefined rendering scheme for the second audio object; and determining the rendering difference based on the first vector and based on the second vector.

3. The method of claim 2, wherein the first vector and the second vector represent input signals for the renderer for rendering the audio objects.

4. The method of claim 2, wherein the elements of the first vector and the second vector are either object-to-speaker gains or filter coefficients.

5. The method of claim 4, wherein the filter coefficients are filter coefficients of a head related transfer function HRTF.

6. The method of claim 1, wherein the renderer includes a speaker renderer and the renderer-related information indicates a reference speaker layout indicating speakers at different positions and a predefined rendering scheme for the speaker renderer, and wherein determining the rendering difference comprises:

determining a first set of object-to-speaker gains for the first audio object and a second set of object-to-speaker gains for the second audio object based on the reference speaker layout and the predefined rendering scheme, an object-to-speaker gain defining a proportion of the respective audio object to be rendered to one of the speakers by the speaker renderer based on the predefined rendering scheme; and determining the rendering difference based on the first and second sets of object-to-speaker gains.

7. The method of claim 6, wherein determining the rendering difference based on the first and second sets of object-to-speaker gains comprises:

determining the rendering difference as being positively correlated with a difference between the first and second sets of object-to-speaker gains.

8. The method of claim 6, wherein determining the rendering difference based on the first and second sets of object-to-speaker gains further comprises:

identifying a first active speaker set including at least one of the speakers to which the first audio object is rendered with a non-zero object-to-speaker gain in the first set;

identifying a second active speaker set including at least one of the speakers to which the second audio object is rendered with a non-zero object-to-speaker gain in the second set; and determining the rendering difference further based on determining whether one of the first and second active speaker sets covers the other one of the first and second active speaker sets.

9. The method of claim 1, wherein the renderer includes a headphone renderer and the renderer-related information indicates a predefined rendering scheme for the headphone renderer, and wherein determining the rendering difference comprises:

determining, based on the predefined rendering scheme, a first filter for rendering the first audio object by the headphone renderer and a second filter for rendering the second audio object by the headphone renderer; and determining the rendering difference based on the first filter and the second filter.

10. The method of claim 9, wherein determining the rendering difference further comprises:

determining the rendering difference further based on an angular difference between spatial positions of the first and second audio objects.

11. The method of claim 9, wherein determining the rendering difference based on the first filter and the second filter comprises:

determining the rendering difference based on a difference between a first spectrum of the first filter and a second spectrum of the second filter.

12. The method of claim 1, wherein clustering the audio objects comprises:

clustering the audio objects by using the rendering difference in place of a spatial distance between the first and second audio objects or in combination with the spatial distance.

13. The method of claim 1, wherein clustering the audio objects comprises:

measuring a masking degree of the first and second audio objects with respect to each other based on the rendering difference;

determining, based on the masking degree, first partial loudness of the first audio object and second partial loudness of the second audio object among the audio objects; and clustering the audio objects based on the first and second partial loudness.

14. The method of claim 13, wherein clustering the audio objects based on the first and second partial loudness comprises:

determining cluster positions based on the first and second partial loudness;

determining, based on the cluster positions, object-to-cluster gains for the audio objects, an object-to-cluster gain defining a proportion of the respective audio object to be allocated to a cluster signal associated with one of the determined cluster positions; and clustering the audio objects based on the object-to-cluster gains.

15. The method of claim 14, wherein determining the cluster positions comprises:

determining initial cluster positions;

generating initial cluster signals by clustering the audio objects based on the initial cluster positions;

measuring, at least in part based on the first and second partial loudness, a rendering distortion between rendering of the audio objects to output channels by the renderer and rendering of the initial cluster signals to the output channels by the renderer; and determining the cluster positions for the cluster signals by updating the initial cluster positions based on the rendering distortion.

16. A system for processing audio objects, comprising:

an information obtaining unit configured to obtain renderer-related information indicating a configuration of a renderer;

a difference determining unit configured to determine, based on the obtained renderer-related information, a rendering difference between a first audio object and a second audio object among the audio objects with respect to the renderer; and a cluster subsystem configured to cluster the first and second audio objects at least in part based on the rendering difference.

17. The system of claim 16, wherein the renderer-related information indicates a predefined rendering scheme for the renderer, and wherein the difference determining unit is configured to:

determine a first vector based on the predefined rendering scheme for the first audio object and a second vector based on the predefined rendering scheme for the second audio object; and determine the rendering difference based on the first vector and based on the second vector.

18. The system of claim 17, wherein the first vector and the second vector represent input signals for the renderer for rendering the audio objects.

19. The system of claim 16, wherein the renderer includes a speaker renderer and the renderer-related information indicates a reference speaker layout indicating speakers at different positions and a predefined rendering scheme for the speaker renderer, and wherein the difference determining unit is configured to:

determine a first set of object-to-speaker gains for the first audio object and a second set of object-to-speaker gains for the second audio object based on the reference speaker layout and the predefined rendering scheme, an object-to-speaker gain defining a proportion of the respective audio object to be rendered to one of the speakers by the speaker renderer based on the predefined rendering scheme; and determine the rendering difference based on the first and second sets of object-to-speaker gains.

20. The system of claim 16, wherein the renderer includes a headphone renderer and the renderer-related information indicates a predefined rendering scheme for the headphone renderer, and wherein the difference determining unit is configured to:

determine, based on the predefined rendering scheme, a first filter for rendering the first audio object by the headphone renderer and a second filter for rendering the second audio object by the headphone renderer; and determine the rendering difference based on the first filter and the second filter.

21. The system of claim 16, wherein the clustering subsystem is configured to cluster the first and second audio objects by using the rendering difference in place of a spatial distance between the first and second audio objects or in combination with the spatial distance.

* * * * *